US010450165B2

(12) United States Patent
Kuczera et al.

(10) Patent No.: US 10,450,165 B2
(45) Date of Patent: Oct. 22, 2019

(54) ELEVATOR WITH A BRAKING DEVICE

(71) Applicant: ThyssenKrupp Elevator AG, Essen (DE)

(72) Inventors: Thomas Kuczera, Leinfelden-Echterdingen (DE); Walter Hoffmann, Niedernhausen (DE); Markus Hänle, Erkenbrechtsweiler (DE); Eduard Steinhauer, Nürtingen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 302 days.

(21) Appl. No.: 15/301,312

(22) PCT Filed: Mar. 27, 2015

(86) PCT No.: PCT/EP2015/056796
§ 371 (c)(1),
(2) Date: Sep. 30, 2016

(87) PCT Pub. No.: WO2015/150285
PCT Pub. Date: Oct. 8, 2015

(65) Prior Publication Data

US 2017/0029247 A1 Feb. 2, 2017

(30) Foreign Application Priority Data

Apr. 3, 2014 (DE) ..... 10 2014 206 461

(51) Int. Cl.
*B66B 5/18* (2006.01)
*B66B 1/32* (2006.01)
(Continued)

(52) U.S. Cl.
CPC ..... *B66B 5/18* (2013.01); *B66B 1/32* (2013.01); *B66B 1/365* (2013.01); *B66B 9/00* (2013.01)

(58) Field of Classification Search
CPC ..... B66B 5/18; B66B 1/32; B66B 1/365
See application file for complete search history.

(56) References Cited

U.S. PATENT DOCUMENTS 3,583,500 A * 6/1971 Randall ..... E21B 21/08 175/38
3,654,837 A * 4/1972 Knapp ..... F15B 11/02 137/503

(Continued)

FOREIGN PATENT DOCUMENTS

CH 684190 A 7/1994
CN 2216061 Y 12/1995

(Continued)

OTHER PUBLICATIONS

Int'l Search Report for PCT/EP2015/056796 dated Jun. 30, 2015 (mailed Jul. 7, 2015).

*Primary Examiner* — Michael A Riegelman
(74) *Attorney, Agent, or Firm* — thyssenkrupp North America, Inc.

(57) ABSTRACT

An elevator may include a brake apparatus such as a safety apparatus or a service brake, for example. The brake apparatus may be designed to generate a stepped braking force for braking an elevator car of the elevator. A plurality of brake cylinder assemblies may be configured so as to supply different braking forces. The brake cylinder assemblies may in some cases include a piston, a spring, and a brake pad. Moreover, a valve assembly may be utilized by one or more of the brake cylinder assemblies. Additional features of the (Continued)

brake apparatus may involve a compressor, a pressure accumulator, a pressure regulating valve.

6 Claims, 5 Drawing Sheets

(51) Int. Cl.
*B66B 1/36* (2006.01)
*B66B 9/00* (2006.01)

(56) References Cited

U.S. PATENT DOCUMENTS 4,031,987 A * 6/1977 Webb ..... F16D 49/16 188/171
4,033,434 A * 7/1977 Henrich ..... F16D 49/16 188/171
4,285,420 A * 8/1981 Sekella ..... F16D 27/11 192/110 R
4,615,174 A * 10/1986 Nagahara ..... F15B 13/0422 60/442
4,720,975 A * 1/1988 Gunter ..... B66D 5/26 60/442
5,014,828 A * 5/1991 Baldassarre ..... B66B 5/18 188/173
5,197,284 A * 3/1993 Cartner ..... F15B 11/0445 60/466
5,228,540 A * 7/1993 Glaser ..... B66B 5/04 187/355
5,244,060 A * 9/1993 Tanaka ..... B66B 1/32 187/261
5,255,760 A * 10/1993 Lamb ..... B66B 5/0006 188/1.11 L
5,265,701 A * 11/1993 Ogasawara ..... B66B 5/18 187/254
5,323,878 A * 6/1994 Nakamura ..... B66B 1/32 187/264
5,353,895 A * 10/1994 Camack ..... B66B 5/18 187/369
5,648,644 A * 7/1997 Nagel ..... B66B 5/18 187/288
5,739,610 A * 4/1998 Nemoto ..... F16D 55/2245 188/158
5,779,325 A * 7/1998 Diesel ..... B60T 13/683 188/170
6,105,738 A * 8/2000 Christen ..... B60T 13/22 188/170
6,142,266 A * 11/2000 Appeldorn ..... B60T 13/743 188/171
6,193,026 B1 * 2/2001 Sevilleja ..... B60T 13/22 187/288
6,585,088 B1 * 7/2003 Fontaine ..... B60T 1/065 188/170
7,267,201 B2 * 9/2007 Ito ..... B66B 5/185 187/366
7,334,403 B2 * 2/2008 Markwart ..... F16H 61/4148 60/460
7,591,351 B2 * 9/2009 Fischer ..... B66B 5/18 188/161
8,091,355 B2 * 1/2012 St. Aubin ..... E02F 9/2203 60/459
8,157,061 B2 4/2012 Gremaud
2002/0117357 A1 * 8/2002 Hugel ..... B66B 5/22 187/376
2005/0126862 A1 * 6/2005 Ito ..... B66B 5/185 187/350
2011/0155523 A1 * 6/2011 Legeret ..... B66B 5/18 188/161
2013/0081907 A1 * 4/2013 Meierhans ..... B66B 5/20 187/359
2015/0191328 A1 * 7/2015 Strbuncelj ..... B66D 5/14 187/254
2016/0152441 A1 * 6/2016 Tschuppert ..... B66B 5/18 303/10
2016/0221795 A1 * 8/2016 Dudde ..... B66B 5/18
2017/0023025 A1 * 1/2017 Hahn ..... F15B 13/0401
2017/0029247 A1 * 2/2017 Kuczera ..... B66B 5/18
2017/0029248 A1 * 2/2017 Kuczera ..... B66B 5/18

FOREIGN PATENT DOCUMENTS

CN 1428287 A 7/2003
CN 101475130 A 7/2009
CN 101861278 A 10/2010
CN 202022696 U 11/2011
DE 20 2004 017 585 U 1/2005
DE 20 2004 017 587 U 1/2005
DE 60 112 294 T 1/2006
DE 10 2007 015 277 A 10/2007
DE 20 2011 051 664 U 1/2012
DE 102012109969 A 4/2013
EP 0650703 A1 5/1995
EP 1 067 084 A 1/2001
EP 1 323 660 A 7/2003
EP 1671912 A 6/2006
JP 50-23729 U 3/1975
JP 1992059579 A 2/1992
JP H04059579 2/1992
JP 1993124777 S 5/1993
JP H05124777 5/1993
JP 07-157232 A 6/1995
WO 98/57833 A1 12/1998
WO 2014/033846 A 3/2014

* cited by examiner

ELEVATOR WITH A BRAKING DEVICE

CROSS REFERENCE TO RELATED APPLICATIONS

This application is a U.S. National Stage Entry of International Patent Application Serial Number PCT/EP2015/056796, filed Mar. 27, 2015, which claims priority to German Patent Application No. DE 10 2014 206 461.9 filed Apr. 3, 2014, the entire contents of both of which are incorporated herein by reference.

FIELD

The present disclosure relates to elevators with braking devices and, more particularly, safety apparatuses and/or service brakes.

BACKGROUND

In the case of elevators, there is an imperative need for safety apparatuses and service brakes which, in the event of overspeeding or uncontrolled traveling movements, decelerate the elevator car of the elevator safely to a standstill, and which hold the elevator car while it is at a standstill.

Safety apparatuses and service brakes generally do not offer the possibility of adjustment of the braking force. That is to say, they generate a constant braking force. Depending on the load state of the elevator car, the passengers are then subjected to different levels of deceleration during a braking process. In particular in the case of a low load, it is then the case, for example, that the passengers are subjected to very high levels of deceleration, whereby, for example, the traveling comfort may be reduced or the risk of an accident may be increased.

EP 0650703 A1 has disclosed an elevator having a brake, the brake force of which can be regulated. However, said brake has a complex construction, which is for example considered to be relatively maintenance-intensive.

There is therefore a demand for an elevator having a brake apparatus which provides a suitable braking force in accordance with the respective situation but which is characterized by a simple construction.

DETAILED DESCRIPTION

Figure 1:
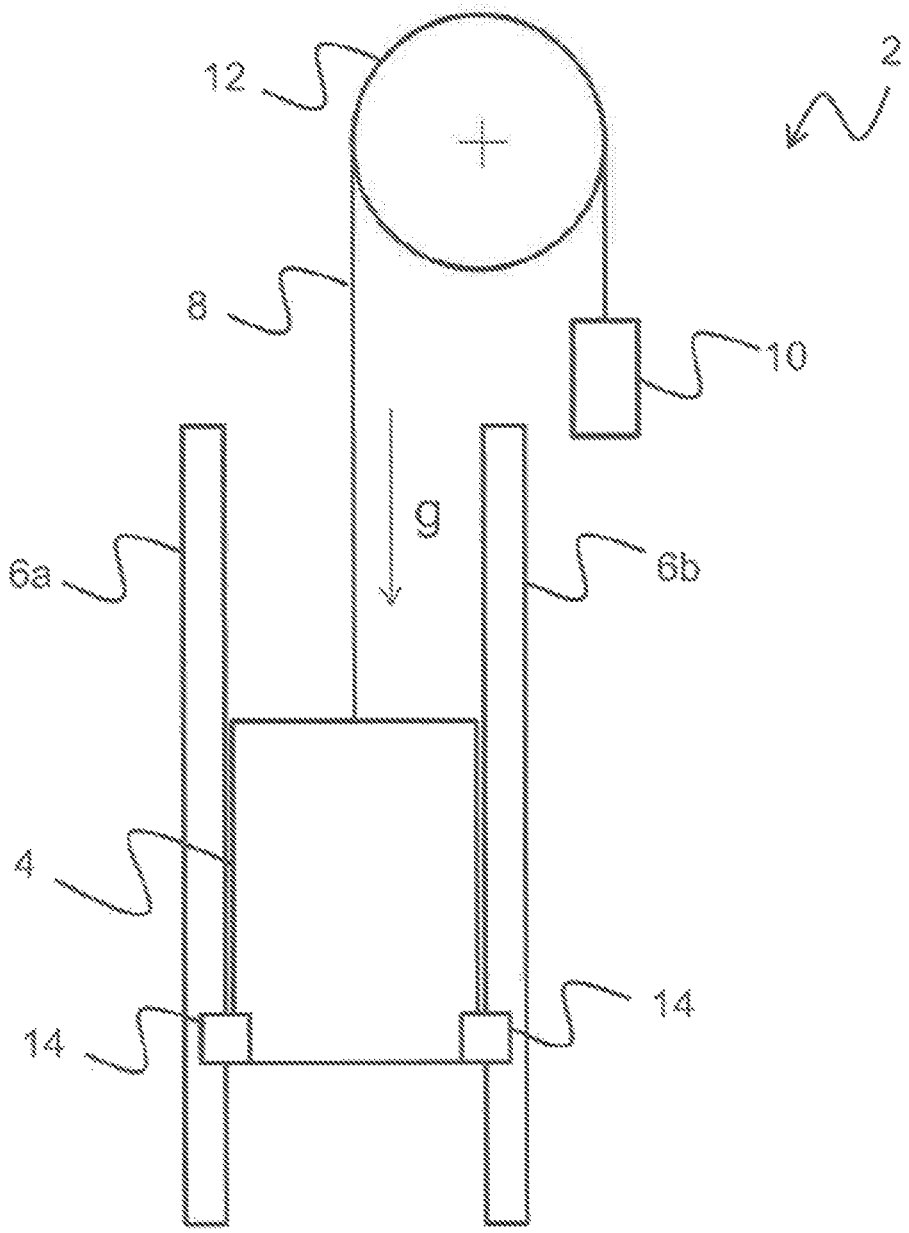
FIG. 1 is a schematic view of an example elevator with an example brake apparatus.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The elevator according to the invention has a brake apparatus, in particular a safety apparatus or a service brake, wherein the brake apparatus is designed to generate a stepped braking force for braking an elevator car of the elevator.

The invention is based on the realization that it is sufficient for the braking force to be provided in stepped fashion in a number of discrete braking steps. Accordingly, for example in the event of an emergency stop, the passengers in the cabin are not subjected to excessive deceleration, regardless of the state of load of the elevator car. A brake apparatus of said type has a considerably simpler construction than a brake that is adjustable in continuously variable fashion.

In one advantageous refinement of the invention, the brake apparatus has a multiplicity of individually actuable brake cylinder assemblies. It is advantageously the case that two to five brake cylinder assemblies are provided. If all of the brake cylinder assemblies are actuated at the same time, a maximum braking force value is provided. By contrast, if only some of the brake cylinder assemblies are actuated, a corresponding partial braking force value is provided. It is thus possible to provide a brake apparatus which has a particularly simple construction.

In an advantageous refinement of the invention, the brake cylinder assemblies are designed to each generate a substantially identical braking force value. In this case, a substantially identical braking force value is to be understood to mean a braking force value which fluctuates for example within manufacturing-induced component tolerances, for example by 5%, 10% or 20%. Accordingly, the brake apparatus can be formed from structurally identical brake cylinder assemblies, which simplifies manufacture and maintenance.

In one advantageous refinement of the invention, the brake cylinder assemblies are designed to generate different braking force values. In this way, through the selection of individual brake cylinder assemblies, it is possible to realize precise metering of the braking force, in particular of two to five, for example three brake cylinder assemblies.

In one advantageous refinement of the invention, the brake apparatus has at least one first brake cylinder assembly and one second brake cylinder assembly. The first brake cylinder assembly is designed to generate a first braking force value and the second brake cylinder assembly is designed to generate a second braking force value. In this case, the second braking force value is greater than the first braking force value, in particular is substantially twice as great as the first braking force value. A braking force which is substantially twice as great is in this case to be understood to mean a braking force value which fluctuates for example within manufacturing-induced component tolerances, for example by 5%, 10% or 20%. Thus, different braking force values can be provided by actuation of one brake cylinder assembly and actuation of the other brake cylinder assembly, such that a braking force can be provided in multiple braking force steps.

In an advantageous refinement of the invention, the brake apparatus has at least one further brake cylinder assembly. The further brake cylinder assembly is designed to generate a further braking force value. In this case, the further braking force value is three to five times, in particular substantially four times, as great as the first braking force value. A braking force value which is substantially four times as great is in this case to be understood to mean a braking force value which fluctuates for example within manufacturing-induced component tolerances, for example by 5%, 10% or 20%. Thus, an even greater number of different braking force values can be provided by actuation of a further brake cylinder assembly, such that the number of braking force steps can be further increased.

In one advantageous refinement of the invention, each brake cylinder assembly is assigned at least in each case one valve for the actuation of the brake cylinder assembly. If, in the event of a fault, a valve for the actuation of one brake cylinder assembly becomes non-functional, it is possible for at least other brake cylinder assemblies to be actuated by way of their respective valves, and thus a partial braking force can be provided. Operational safety is thus increased.

In one advantageous refinement of the invention, the brake apparatus has two brake units, of which a first brake unit is assigned to a first guide rail of the elevator and a second brake unit is assigned to a second guide rail of the elevator, wherein each brake unit has in each case one brake cylinder assembly, wherein a brake cylinder assembly of the first brake unit and a brake cylinder assembly of the second brake unit are assigned to in each case one valve assembly for the actuation of the brake units. Thus, owing to the actuation of the two braking units by way of one valve assembly, a symmetrical deceleration of the elevator car at both guide rails is attained.

In one advantageous refinement of the invention, the two brake units have the same number of brake cylinder assemblies. It is thus possible for the two brake units to be of structurally identical form, which simplifies manufacture and maintenance.

Further advantages and refinements of the present disclosure will emerge from the description below, which makes reference to the appended figures.

Those having ordinary skill in the art will understand that the exemplary features mentioned above and the exemplary features yet to be discussed below may be used not only in the respectively specified combinations but also in many other combinations or individually without departing from the scope of the present disclosure.

FIG. 1 schematically illustrates an elevator 2 as a preferred refinement of an elevator system according to the invention.

In the present exemplary embodiment, the elevator 2 has an elevator car 4 for the transportation of passengers and/or loads, which elevator car is mounted on two guide rails 6*a*, 6*b*, which run parallel to one another, in an elevator shaft such that said elevator car can travel in or counter to the direction of gravitational force g. By contrast to the present exemplary embodiment, it is however for example also possible for the elevator car 4 to be mounted, such that it can travel, on a single guide rail.

For the travel of the elevator car 4, a drive is provided which, in the present exemplary embodiment, is in the form of a driving-pulley drive. In this case, the elevator car 4 may have a cabin and a safety frame (neither of which are illustrated). In the present exemplary embodiment, the drive has a supporting cable 8 which is fastened to the top side of the elevator car 4. The supporting cable 8 runs on a driving pulley 12 which can be motor-driven by means of a motor (not illustrated) in order to cause the elevator car 4 to travel. In the present exemplary embodiment, a counterweight 10 is fastened to the other end, which is situated opposite the elevator car 4, which counterweight 10, by weight balancing, reduces the force expenditure required for causing the elevator car 4 to travel. By contrast to the present exemplary embodiment, the elevator may be designed as an elevator without supporting means. An elevator without supporting means is an elevator system which does not use cables or belts which are driven by means of a driving pulley 12. The drive of such elevators is situated directly on the elevator car 4. Here, use is made, for example, of toothed-rack drives and linear drives.

To brake the elevator car 4 to a standstill, for example if overspeeding and/or uncontrolled traveling movements of the elevator car 4 occur, a brake apparatus 14 is provided, which in the present exemplary embodiment is in the form of a safety apparatus and/or service brake.

Figure 2:
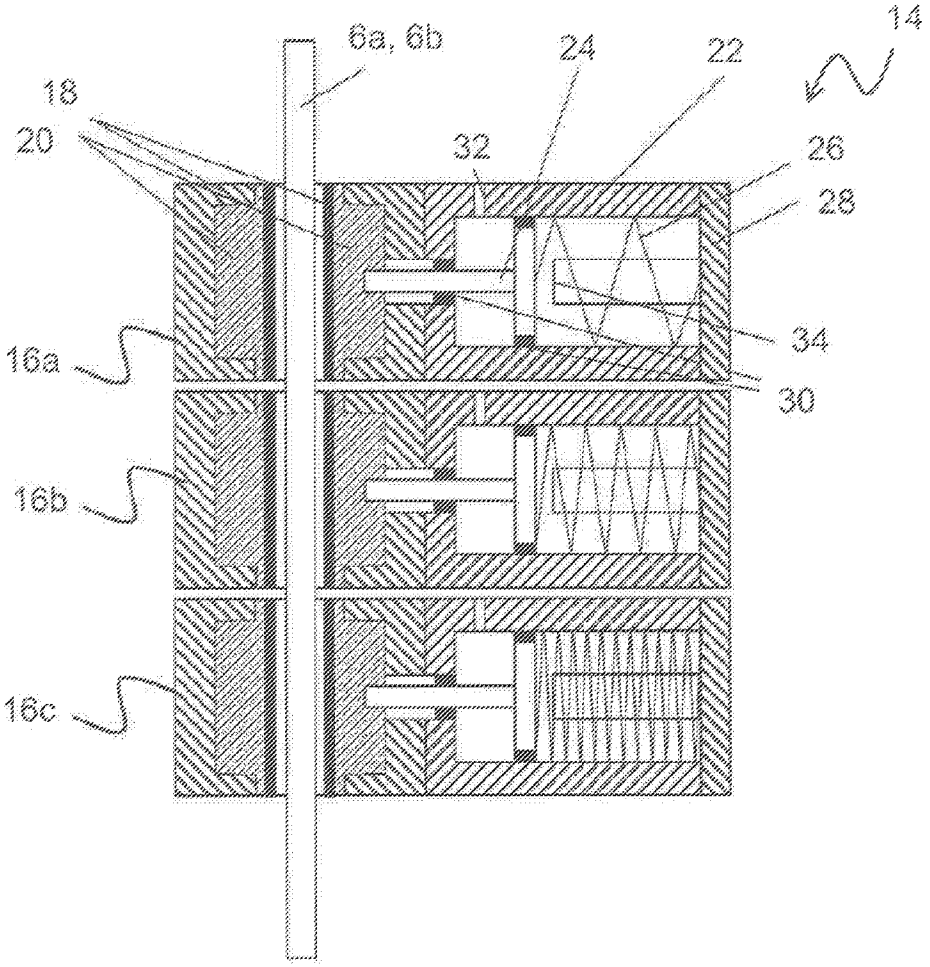
FIG. 2 is a schematic view of the brake apparatus of FIG. 1.

FIG. 2 shows the brake apparatus 14 in detail.

In the present exemplary embodiment, the brake apparatus 14 comprises in each case three brake cylinder assemblies 16*a*, 16*b*, 16*c*, which are arranged to both sides of the elevator car 4. By contrast to the present exemplary embodiment, it is however also possible for the brake apparatus 14 to have only two, or more than three, for example four or five, brake cylinder assemblies. The brake cylinder assemblies 16*a*, 16*b*, 16*c* interact with the guide rail 6*a* or 6*b* in order to brake the elevator car 4. For this purpose, each brake cylinder assembly 16*a*, 16*b*, 16*c* has, to both sides, in each case one brake pad 18 which, in the present exemplary embodiment, is of flat, that is to say substantially cuboidal form. The brake pads 18 are inserted into a respective brake pad holder 20 of each of the brake cylinder assemblies 16*a*, 16*b*, 16*c*. The brake cylinder assemblies 16*a*, 16*b*, 16*c* are mounted in floating fashion, that is to say the brake cylinder assemblies 16*a*, 16*b*, 16*c* are mounted so as to be horizontally displaceable in order to ensure uniform abutment of the brake pads 18.

Each brake cylinder assembly 16*a*, 16*b*, 16*c* has a cylinder 22 in which a piston 24 is mounted in displaceable fashion, wherein the piston 24 is operatively connected to the brake pads 18 in order to place the latter in contact with the guide rails 6*a*, 6*b* when the elevator car 4 is to be braked. The piston 24 is furthermore subjected to spring preload by means of a spring 26, which in the present exemplary embodiment is in the form of a compression spring, wherein the spring 26 generates the contact pressure for placing the brake pads in contact with the guide rails 6*a*, 6*b*. In this case, a cover 28 closes off the cylinder 22, which is open on one side. Seals 30 are provided for sealing off the piston 24. Finally, each brake cylinder assembly 16*a*, 16*b*, 16*c* has a respective pressure medium port 32 for the ventilation of the brake apparatus 14.

In the present exemplary embodiment, the brake cylinder assemblies 16*a*, 16*b*, 16*c* are designed to generate different braking forces. In the present exemplary embodiment, the first brake cylinder assembly 16*a* is designed to generate a braking force value of 5 kN, the second brake cylinder assembly 16*b* is designed to generate a braking force value of 10 kN, and the third brake cylinder assembly 16*c* is designed to generate a braking force value of 20 kN. By contrast to the present exemplary embodiment, the braking force values may also be staggered differently.

Thus, the third brake cylinder assembly 16*c* generates a braking force value which is twice as great as the braking force value generated by the second brake cylinder assembly 16*b*. Furthermore, the second brake cylinder assembly 16*b* generates a braking force value which is four times as great as the braking force value generated by the first brake cylinder assembly 16*a*.

Thus, through individual actuation of selected brake cylinder assemblies 16*a*, 16*b*, 16*c*, it is possible for braking forces with values of 5 kN, 10 kN, 15 kN, 20 kN, 25 kN, 30 kN and 35 kN to be generated. The brake apparatus thus has seven braking force steps, and generates a stepped braking force with seven steps.

To generate the different braking forces, it is provided in the present exemplary embodiment that the springs 26 of the brake cylinder assemblies 16*a*, 16*b*, 16*c* are of different strength. If all of the brake cylinder assemblies 16*a*, 16*b*, 16*c* are charged with the same operating pressure, for example of the hydraulic oil, different spring forces act in each of the brake cylinder assemblies 16*a*, 16*b*, 16*c*, which spring forces lead to different deflections of the pistons 24 in each case.

In the present exemplary embodiment, a stop 34 is provided in each cylinder 22, which stop delimits a displacement travel of the piston 24. Instead of the stop 34, it would be possible for the base surface area of the pistons 24 of the brake cylinder assemblies 16*a*, 16*b*, 16*c* to be varied, or the brake cylinder assemblies 16*a*, 16*b*, 16*c* are charged with in each case different operating pressures in order to generate different braking forces.

By contrast to this, it is however possible for the brake cylinder assemblies 16*a*, 16*b*, 16*c* to be designed to generate identical braking forces.

Figure 3:
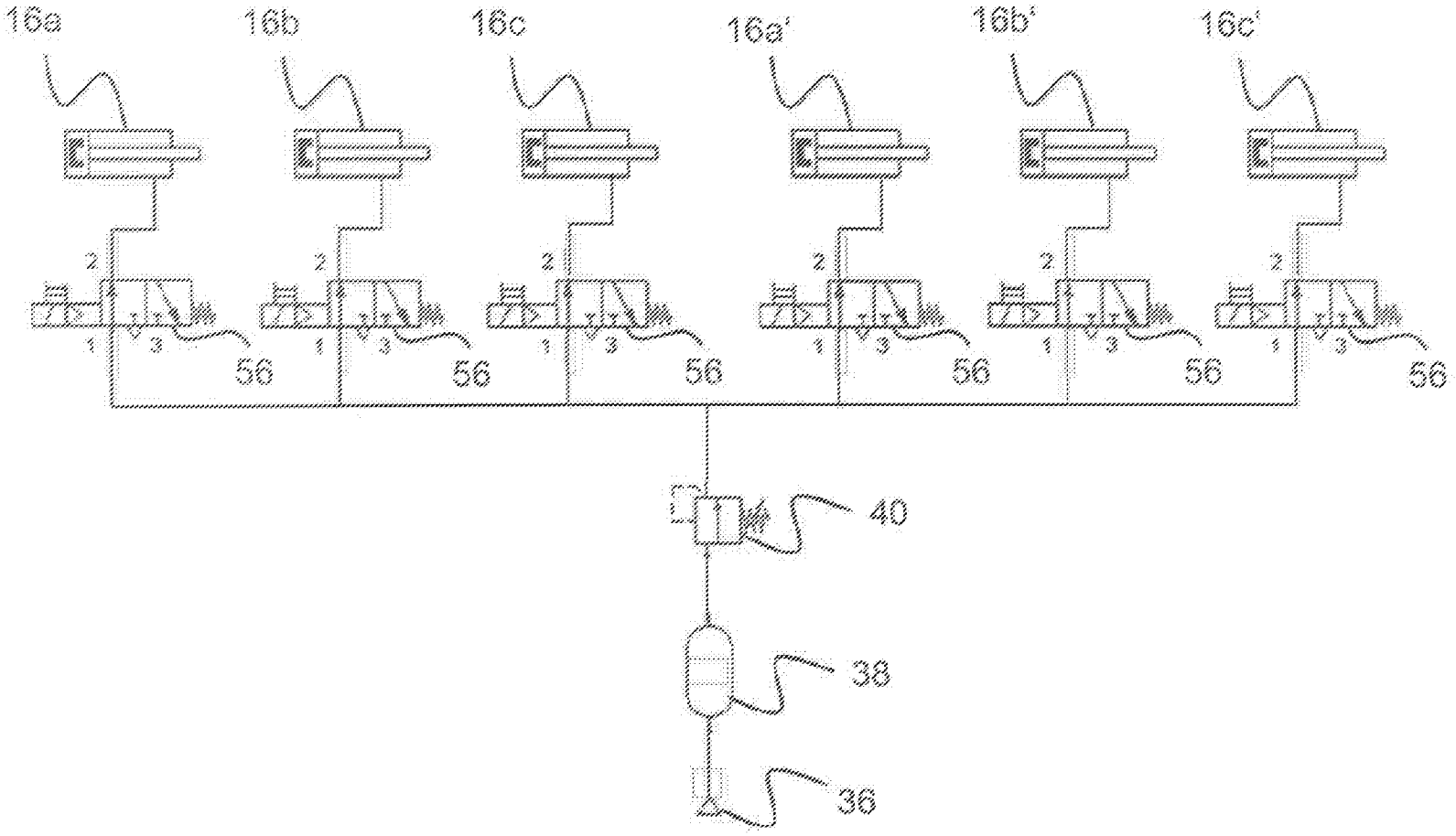
FIG. 3 is a schematic diagram of example brake cylinder assemblies with valves.

FIG. 3 shows an exemplary embodiment of the brake apparatus 14 in which in each case three brake cylinder assemblies 16*a*, 16*b*, 16*c*, 16*a*', 16*b*', 16*c*' are provided for both sides of the elevator car 4.

In each case one valve 56 is assigned to a respective one of the brake cylinder assemblies 16*a*, 16*b*, 16*c*; 16*a*', 16*b*', 16*c*'.

For the supply of pressure to the brake apparatus 14, a motor-driven compressor 36 is provided in the present exemplary embodiment. Between the compressor 36 and the valves 56 there is provided a pressure accumulator 38 which provides a pressure higher than the minimum operating pressure of the brake apparatus 14. At the same time, the pressure accumulator 38 serves as a buffer, for example in the event of an electrical failure. The pressure accumulator 38 then provides a reserve with which the elevator car 4 can be released from the arresting action by a triggered brake apparatus 14, for example in order that said elevator car can be caused to travel to a nearest stopping point of the elevator 2 for the purposes of passenger evacuation. Furthermore, the pressure accumulator 38 serves as a reserve in the event of, for example, frequent switching cycles, such that a smaller compressor 36 can be used than in the case of a design without a pressure accumulator 38.

Furthermore, in the present exemplary embodiment, a pressure limiting valve or pressure regulating valve 40 is provided between the valves 56 and the pressure accumulator 38, as a pressure prevailing in the pressure accumulator 38 may be higher than that required for the restoring movements of the brake cylinder assemblies 16*a*, 16*b*, 16*c*; 16*a*', 16*b*', 16*c*' counter to the spring 26. In the present exemplary embodiment, the valves 56 themselves are in the form of 3/2 directional valves.

By contrast to the illustration in FIG. 3, it is possible for in each case two valves 56 connected in parallel to be provided for each of the brake cylinder assemblies 16*a*, 16*b*, 16*c*, 16*a*', 16*b*', 16*c*' in order to provide redundancy.

Figure 4:
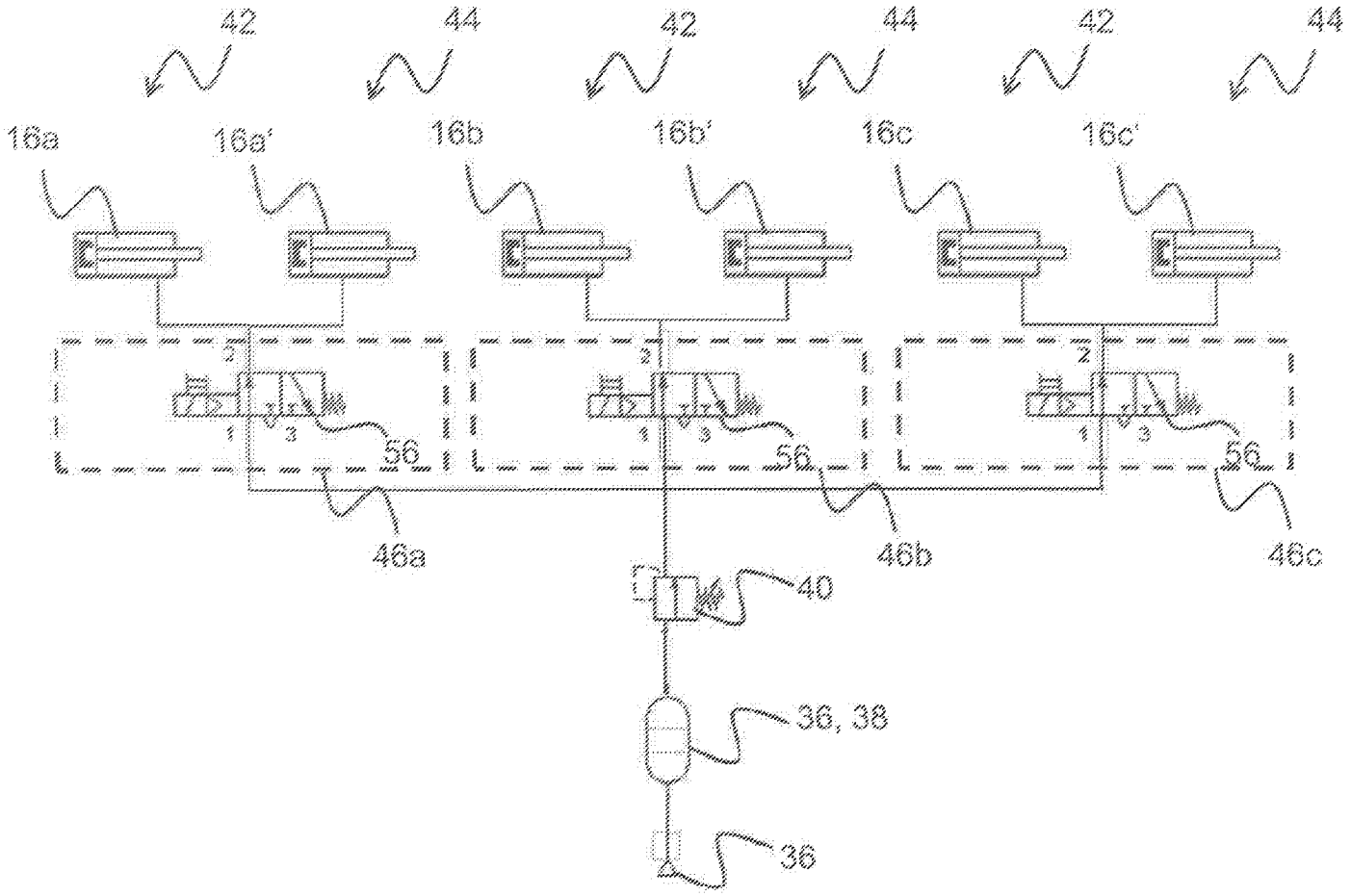
FIG. 4 is a schematic diagram of additional example brake cylinder assemblies with valves.

The exemplary embodiment shown in FIG. 4 differs from the exemplary embodiment shown in FIG. 3 in that the brake apparatus 14 has two brake units 42, 44. The first brake unit 42 is assigned to the first guide rail 6*a* of the elevator 2 and the second brake unit 44 is assigned to the second guide rail 6*b* of the elevator 2. In the present exemplary embodiment, each brake unit 42, 44 has in each case three brake cylinder assemblies 16*a*, 16*b*, 16*c* and 16*a*', 16*b*', 16*c*' respectively. In this case, the brake cylinder assembly 16*a* of the first brake unit 42 and the brake cylinder assembly 16*a*' of the second brake unit 44 are assigned to a valve assembly 46*a* with one of the valves 56. Furthermore, the brake cylinder assembly 16*b* of the first brake unit 42 and the brake cylinder assembly 16*b*' of the second brake unit 44 are assigned to a second valve assembly 46*b* with one of the valves 56. Finally, the brake cylinder assembly 16*c* of the first brake unit 42 and the brake cylinder assembly 16*c*' of the second brake unit 44 are assigned to a third valve assembly 46*c* with one of the valves 56. Thus, in the present exemplary embodiment, the two brake units 42, 44 have the same number of brake cylinder assemblies 16*a*, 16*b*, 16*c* and 16*a*', 16*b*', 16*c*' respectively. Furthermore, in each case two brake cylinder assemblies 16*a*, 16*b*, 16*c* and 16*a*', 16*b*', 16*c*' respectively are assigned in each case one valve 56. Thus, through the actuation of the respective valves 56, a braking force of equal magnitude is effected at both guide rails 6*a* and 6*b*, which yields a symmetrical deceleration of the elevator car 4 on both sides in a simple manner.

Figure 5A:
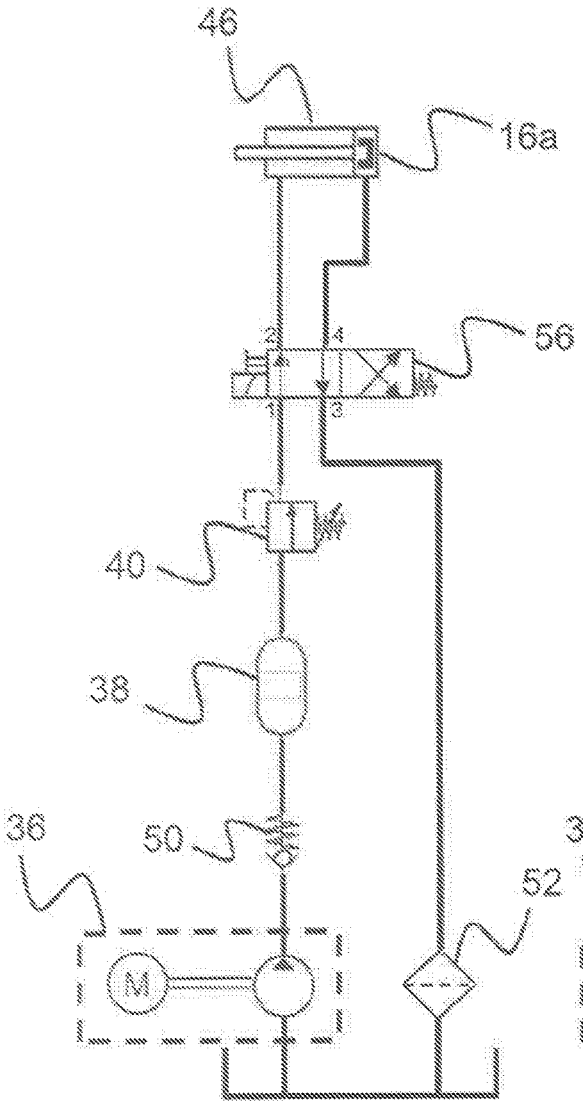
FIGS. 5*a* and 5*b* are schematic diagrams of example brake cylinder assemblies.
Figure 5B:
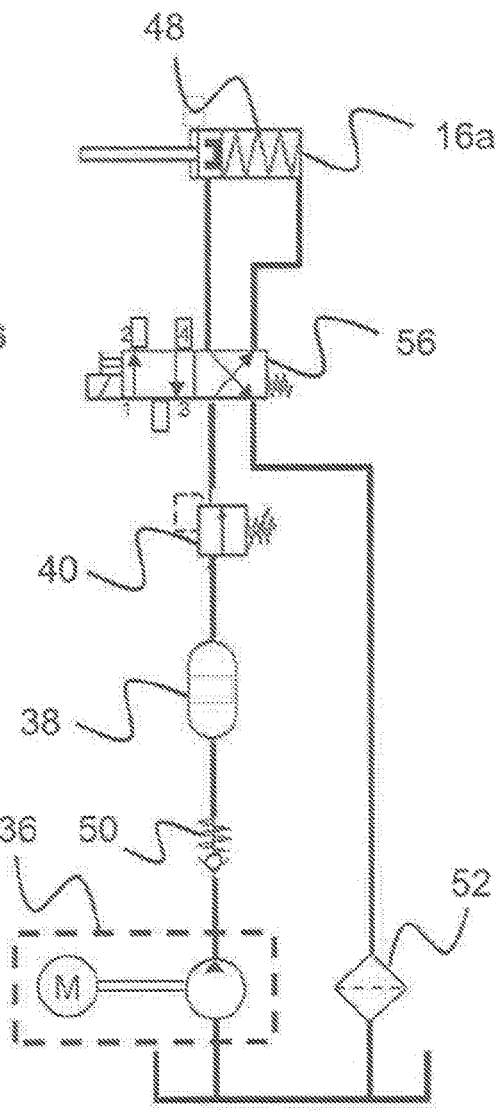

By contrast to the illustration in the figure, it may be provided that each valve assembly 46*a*, 46*b*, 46*c* has in each case two valves 56 connected in parallel in order to provide redundancy. FIGS. 5*a* and 5*b* show, by way of example on the basis of the brake cylinder assembly 16*a*, a further exemplary embodiment in which the valves 56 are in the form of 4/2 directional valves. Furthermore, in this exemplary embodiment, the brake cylinder assembly 16*a* is of double-acting design. Thus, when the brake apparatus 14 is open, a first chamber 48 of the brake cylinder assembly 16*a* is charged with a pressure medium, such as for example hydraulic oil, whereas when the brake apparatus 14 is closed, a second chamber 50 of the brake cylinder assembly 16*a* is charged with the pressure medium. Thus, in addition to the spring force of the spring 26, the pressure medium acts on the piston 24 in order to displace the latter. Furthermore, in the exemplary embodiment as per FIG. 5, a check valve 52 and a collecting vessel 54 are provided.

During operation, a controller (not illustrated) measures the present acceleration and speed of the elevator car 4 and evaluates these with regard to whether limit values are overshot. The controller switches the brake cylinder assemblies 16*a*, 16*b*, 16*c* and 16*a*', 16*b*', 16*c*' in a manner dependent on the load state of the elevator car 4. Furthermore, for reliable control, an emergency power generator or battery is provided in order that, in the event of an electrical failure, a situation is prevented in which all of the brake cylinder assemblies 16*a*, 16*b*, 16*c* and 16*a*', 16*b*', 16*c*' abruptly engage and effect an excessive deceleration of the elevator car 4.

The valves 56 are furthermore switched such that the safe state of the valves 56 in the event of an electrical failure causes the brake apparatus 14 to be engaged (activated).

What is claimed is:

1. An elevator comprising:

an elevator car; and a brake apparatus configured to generate a selectively variable stepped braking force for braking the elevator car, in which the stepped braking force to be generated is selected from a finite number of discrete force values, the brake apparatus comprising, a plurality of individually-actuatable brake cylinder assemblies that each generate a braking force that is different than the amount of braking force generated by the other of the respective brake cylinder assemblies, wherein the plurality of individually-actuatable brake cylinder assemblies can be actuated in various combinations to apply a stepwise variable amount of total braking force selected from a finite number of discrete force values, dependent on the specific combination of brake cylinder assemblies that are actuated, wherein the plurality of individually-actuatable brake cylinder assemblies of the brake apparatus comprises, a first brake cylinder assembly that generates a first braking force, a second brake cylinder assembly that generates a second braking force that is at least two times greater than the first braking force generated by the first brake cylinder assembly, and a third brake cylinder assembly that generates a third braking force that is between three and five times greater than the first braking force generated by the first brake cylinder assembly.

2. The elevator of claim 1 wherein the plurality of individually-actuatable brake cylinder assemblies are each in fluid communication with the same operating pressure.

3. A brake for a safety apparatus or a service brake of an elevator, comprising:

a brake apparatus configured to generate a selectively variable stepped braking force for braking an elevator car of the elevator, in which the stepped braking force to be generated is selected from a finite number of discrete force values, the brake apparatus comprising, a plurality of springs configured to generate braking force, wherein the amount of braking force generated by each respective spring is different than an amount of braking force generated by each of the other of the respective springs, wherein the plurality of springs can be actuated in various combinations to apply a stepwise amount of total braking force selected from a finite number of discrete force value steps, dependent on the specific combination of springs that are actuated to generate braking force.

4. A brake apparatus for an elevator, the brake apparatus comprising:

a plurality of individually-actuatable brake cylinder assemblies braking an elevator car, in which the stepped braking force to be generated is selected from a finite number of discrete force values, wherein each brake cylinder assembly includes a spring configured to generate braking force, and the amount of braking force generated by each respective spring is different than an amount of braking force generated by each of the other of the respective springs; and a plurality of valves for the actuation of the plurality of brake cylinder assemblies.

5. The brake apparatus of claim 4 wherein the plurality of individually-actuatable brake cylinder assemblies are each in fluid communication with the same operating pressure.

6. An elevator comprising:

an elevator car; and a brake apparatus configured to generate a selectively variable stepped braking force for braking the elevator car, in which the stepped braking force to be generated is selected from a finite number of discrete force values, the brake apparatus comprising, a plurality of individually-actuatable brake cylinder assemblies that each generate a braking force that is different than the amount of braking force generated by the other of the respective brake cylinder assemblies, wherein each of the plurality of individually-actuatable brake cylinder assemblies includes a spring configured to generate braking force, and the amount of braking force generated by each respective spring is different than an amount of braking force generated by each of the other of the respective springs.

* * * * *